US009446417B2

(12) United States Patent
Gaudio et al.

(10) Patent No.: US 9,446,417 B2
(45) Date of Patent: Sep. 20, 2016

(54) VIBRATION RESPONSE AND TUNING OF A CENTER OF MASS/GRAVITY OF A CENTRIFUGE

(71) Applicant: BioNex Solutions, Inc., Sunnyvale, CA (US)

(72) Inventors: Stephen Gaudio, Mountain View, CA (US); Eric Rollins, Los Gatos, CA (US)

(73) Assignee: BioNex Solutions, Inc., San Jose, CA (US)

( * ) Notice: Subject to any disclaimer, the term of this patent is extended or adjusted under 35 U.S.C. 154(b) by 560 days.

(21) Appl. No.: 13/749,638

(22) Filed: Jan. 24, 2013

(65) Prior Publication Data

US 2013/0190161 A1 Jul. 25, 2013

Related U.S. Application Data

(60) Provisional application No. 61/590,754, filed on Jan. 25, 2012.

(51) Int. Cl.
*E04B 9/14* (2006.01)
*E04B 5/04* (2006.01)
(Continued)

(52) U.S. Cl.
CPC ..... *B04B 9/14* (2013.01); *B04B 5/0421* (2013.01); *B04B 9/146* (2013.01)

(58) Field of Classification Search
CPC ..... B04B 9/14; B04B 5/04; B04B 5/0407; B04B 5/0414; B04B 5/0421; B04B 2005/0435; B04B 9/12
USPC ..... 494/16, 20, 44, 47, 62
See application file for complete search history.

(56) References Cited

U.S. PATENT DOCUMENTS 2,559,708 A * 7/1951 Calhoun ..... D06F 23/02 415/116
3,322,338 A * 5/1967 Woodall et al. ..... 494/9
(Continued)

FOREIGN PATENT DOCUMENTS

WO WO 00038046 A1 * 6/2000 ..... B04B 11/00

OTHER PUBLICATIONS

Arrayiy Corporation, "Products-Microarray Instruments-Microarray Microplate Centrifuges—Microarrays Life Sciences Diagnostic Healthcare," 1993-2010, 8 Pages [online] [retrieved on Jun. 9, 2011] Retrieved from the internet <URL:http:www.arrayit.com/Products/Microarray_Instruments/Microplate_Ce . . . >.
(Continued)

*Primary Examiner* — Charles Cooley
*Assistant Examiner* — Shuyi S Liu
(74) *Attorney, Agent, or Firm* — Fenwick & West LLP

(57) ABSTRACT

Centrifuges have been designed in the past for centrifuging multi-welled containers, but they are limited in centripetal acceleration or have a large footprint. The invention provides a centrifuge with a high centripetal acceleration and imbalance tolerance while maintaining a small footprint and being able to integrate with laboratory automation equipment. Methods and apparatuses for centrifugation include a rotor assembly positioned within a shield assembly suspended in a centrifuge. The rotor assembly is operably connected to the motor for rotating payloads (e.g., multi-welled containers) around an axis. The shield assembly is positioned such that the center of mass is aligned with the axis of rotation of the rotor assembly and the plane containing the rotational imbalance force vector. This alignment allows rotation of the container with an acceleration of at least 2000 g (or at least 3000 g, 4000 g, 5000 g, etc.).

27 Claims, 5 Drawing Sheets

(51) Int. Cl.
*B04B 9/14* (2006.01)
*B04B 5/04* (2006.01)

(56) References Cited

U.S. PATENT DOCUMENTS

| | | | | |
|---|---|---|---|---|
| 3,536,252 | A * | 10/1970 | Oster | 494/19 |
| 4,534,755 | A * | 8/1985 | Calvert | B04B 11/04 494/37 |
| 5,480,484 | A * | 1/1996 | Kelley et al. | 118/52 |
| 5,601,522 | A * | 2/1997 | Piramoon | 494/16 |
| 6,764,438 | B2 * | 7/2004 | Potter | 494/12 |
| 2004/0002415 | A1 * | 1/2004 | Jang | 494/10 |
| 2009/0023572 | A1 * | 1/2009 | Backes et al. | 494/20 |

OTHER PUBLICATIONS

Comparenetworks, Inc., "MPS1000 Mini Plate Spinners from Denville Scientific, Inc.," 2009-2011, 1 Page [online] [retrieved on Jun. 9, 2011] Retrieved from the internet <URL:http:www.labcompare.com/1266-Microplate-Centrifuge/4032-MPS10 . . . >.

Comparenetworks, Inc., "PCR Plate Spin Down Centrifuge from Phenix Research Products," 2009-2011, 2 Pages [online] [retrieved on Jun. 9, 2011] Retrieved from the internet <URL:http:www.labcompare.com/1266-Microplate-Centrifuge/42553-PCR-P1 . . . >.

Velocity 11, "VSpin Technical Specifications," 2 pages, [online] [retrieved on Jun. 9, 2011] Retrieved from the internet <URL:http:www.velocity11.com/node/40 . . . >.

Biocompare "Watch Video: Agilent Microplate Centrifuge with Centrifuge Loader," Oct. 29, 2010, 2 pages [online] [retrieved on May 6, 2013] Retrieved from the internet <URL:http://www.biocompare.com/Life-Science-Videos/39907-Watch-Video-Agilent-Microplate-Centrifuge-with-Centrifuge-Loader-Streaming-Video/>.

Youtube, "Agilent Microplate Centrifuge with Centrifuge Loader," Uploaded by Labcompare on Jan. 7, 2011, 3 pages, [online] [retrieved on Jun. 9, 2011] Retrieved from the internet <URL: http://www.youtube.com/watch?v=gtlkInIKlig>.

* cited by examiner

Load/Unload Position

Running Position

Running Position/Internal Components Visible

VIBRATION RESPONSE AND TUNING OF A CENTER OF MASS/GRAVITY OF A CENTRIFUGE

CROSS-REFERENCE TO RELATED APPLICATIONS

This application claims the benefit of U.S. Provisional Application No. 61/590,754, filed Jan. 25, 2012, the entire disclosure of which is hereby incorporated by reference herein in its entirety.

BACKGROUND OF THE INVENTION

1. Field of the Invention

The invention relates to vibration response and tuning of the center of mass or gravity of a centrifuge to provide high centripetal acceleration of a multi-welled container.

2. Description of the Related Art

Centrifuges are commonly used in laboratories to separate contents of a sample, remove bubbles in the sample, or otherwise modify the contents of a container via centrifugation. A centrifuge operates by rotating an object around a fixed axis and applying a force perpendicular to the axis. The centripetal acceleration of a centrifuge causes denser substances to separate out to the bottom of the container while lighter substances move to the top of the container. Increasing the gravitational force or g-force on the container will cause the contents of the container to more rapidly and completely separate or precipitate. A quicker and more effective centrifuge means that lab protocols can be completed more rapidly and means that fewer centrifuges are required since there is less need to run multiple centrifuges in parallel. Furthermore, some laboratory processes do not work if not enough g-force is applied to the samples.

Designing an effective, high g-force centrifuge can be a challenge, however. Centrifuges must be carefully balanced. When rotating a rotor around a fixed axis within the centrifuge at very high speeds, the centrifuge will commonly experience tilting or rotation if not properly balanced. Tilting of the centrifuge gives rise to gyroscopic forces that impart additional load on spindle bearings used in balancing the rotor, which wastes motor power and limits the g-forces obtainable. Thus, it is problematic to design a centrifuge that can use motor power effectively, has a low displacement during vibration, and has low vibration emissions to the foundation of the centrifuge, among other issues.

Centrifuging the contents of multi-welled containers, such as micro plates, is especially challenging due to the fact that there are many wells, only some of which may hold samples, including samples of different types. Small differences in mass of the load in the centrifuge can result in a large force imbalance when the rotor of the centrifuge is at a high speed. Thus, centrifuges that hold micro plates are more difficult to balance. As a result, they tend to be limited in the amount of centripetal acceleration that they can handle. Tabletop or laboratory benchtop microplate centrifuges can typically operate at 1000 g maximum, and most operate at less than that. They commonly have a maximum imbalance tolerance of 10 grams or less. Smaller centrifuges typically can only hold vials, and they only have tiny rotor. However, to centrifuge microplates, a bigger rotor is needed.

To provide a microplate centrifuge that can handle a larger centripetal acceleration, the centrifuge typically must be made much larger than standard tabletop centrifuges. These larger centrifuges are generally floor-mounted and are many times the size of the tabletop models. With these much larger centrifuges, the imbalance forces or oscillations/vibrations of the centrifuge can be overwhelmed due to the size and weight of the centrifuge. While these larger centrifuges can provide higher centripetal acceleration, they often are too large and unwieldy to use in laboratories. They have huge footprints, taking up valuable lab space. They are generally too big to integrate with other laboratory automation, such as robotic liquid handling stations that have robotic arms designed to load and unload multi-welled containers from centrifuges. Since the robotic arms cannot operate with these larger centrifuges, such loading/unloading must be performed manually, making the lab less efficient.

Centrifuges still have not overcome these various shortcomings. Currently, there are no multi-welled container centrifuges that solve the problems above, including permitting a high centripetal acceleration and imbalance tolerance while maintaining a small footprint and being robot accessible or able to integrate with laboratory automation equipment.

SUMMARY OF THE INVENTION

Disclosed herein is a centrifuge apparatus comprising a shield assembly and a rotor assembly that together comprise a suspendable mass that can be suspended within a fixed structure of the centrifuge apparatus. The fixed structure is a shell that can be mechanically attached by a user to a foundation (such as a table, benchtop, etc.). The suspendable mass can be suspended in the centrifuge apparatus with one or more suspension components (e.g., plain tension springs or other suspension devices). The suspension components reduce the vibrational forces transmitted to the foundation of the centrifuge apparatus. The rotor assembly is capable of carrying a payload and a motor rotates the rotor assembly within the shield assembly. The center of gravity of the suspendable mass is aligned with the center of rotation of the rotor assembly and is aligned with the expected imbalanace vector plane. This reduces vibration motion or tilting of the suspendable mass resulting from imbalance during operation, which 1) reduces transmission of vibration to the foundation (e.g., due to less vibrational displacement of the suspendable mass and resulting lower vibrational forces supported by the suspension components), and 2) reduces motor power requirements, since the motor power does not have to work against gyroscopic forces due to tilting of the suspendable mass (lower motor power consumption per rotor speed). This alignment allows a high imbalance tolerance, which is otherwise a rather strict constraint the end user must meet with a centrifuge (a significantly inconvenient task, sometimes; vibrations transmitted to the end user's foundation is highly undesirable). In addition, since the suspendable mass serves as the shield containing the rotor assembly, the heaviness of the shield increases the efficacy of overall vibration isolation between imbalance and foundation, and also increases safety.

In one embodiment of the centrifuge apparatus, the suspendable mass comprises the shield assembly, a motor attached to the shield assembly, and a rotor assembly is positioned within the shield assembly. The rotor assembly comprises a rotor, a spindle shaft attached to the rotor and operably connected to the motor for rotating the rotor about an axis, at least two buckets moveably attached to a rotor. Each bucket can include a container platform for holding a payload, such as a container having a plurality of wells. The buckets are configured to swing the container away from the spindle shaft during rotation to centrifuge the contents of the wells. The center of gravity of the suspendable mass is aligned with a center of rotation of the rotor assembly and/or with an expected imbalance force vector plane. In some embodiments, one or both of these types of alignments unexpectedly allow rotation of the container with an acceleration of at least 2000 g (or at least 3000 g, 4000 g, 5000 g, etc.), a substantial advancement over other centrifuges (e.g., centrifuges of this compact size that centrifuge multi-welled containers).

Another embodiment of the invention is a centrifuge apparatus comprising a suspendable mass that is suspendable within the centrifuge apparatus. The suspendable mass comprises a shield assembly, a rotor, buckets, and a motor. The rotor is positioned within the shield assembly for rotation around an axis. In one embodiment, the center of mass of the suspendable mass is aligned with the axis of rotation of the rotor and aligned with the plane containing a rotational imbalance force vector for the suspendable mass. Buckets are moveably attached to the rotor for holding a payload, such as a container having a plurality of wells. The motor is operably connected to the rotor within the shield assembly for rotating the rotor around the axis of rotation with an acceleration of at least 2000 g (or at least 3000 g, 4000 g, 5000 g, etc.) to centrifuge the contents of the wells.

Another embodiment of the centrifuge apparatus comprises a rigid body and a force applied to that rigid body. The rigid body comprises a stationary shield and a rotor assembly that are suspended within the centrifuge apparatus by compliant elements, the rotor assembly capable of rotation around an axis of rotation within the stationary shield. The rigid body has its center of mass aligned with the axis of rotation and aligned with a horizontal plane bisecting the rotor assembly. A force is applied to the rigid body for rotating the rotor assembly within the shield assembly. The line of action of the force contains the center of mass of the rigid body and the rigid body is positioned to accelerate in a translational manner, but not in (e.g., not in or not substantially in) a rotational manner responsive to the force applied.

Another embodiment of the invention is a method of centrifuging the contents of wells of a container. The method comprises loading a payload, such as a container into a rotor assembly within a centrifuge apparatus, where the container can have multiple wells some or all of which may contain samples. The method also comprises rotating the rotor assembly within the centrifuge apparatus around a rotational axis with a centripetal acceleration of at least 2000 g (or at least 3000 g, 4000 g, 5000 g, etc.) to centrifuge the samples in the wells. The method further comprises unloading the container from the centrifuge apparatus, where the components of the samples have been centrifuged by the rotation of the rotor assembly.

Another embodiment of the invention is a method of tuning a centrifuge. The method comprises providing a centrifuge for tuning, the centrifuge having a rotor suspended within a shield assembly for rotation around an axis. The method also comprises aligning the center of mass of the centrifuge apparatus with the axis of rotation and with a plane containing the rotational imbalance force vector for the rotor. The alignment allows the rotor to rotate a container having a plurality of wells around the axis of rotation with an acceleration of at least 2000 g (or at least 3000 g, 4000 g, 5000 g, etc.) to centrifuge the samples in the wells.

The design of the centrifuge apparatus allows for high rotor imbalance without or substantially without detrimental vibration forces being transmitted to the foundation via the fixed structure of the centrifuge apparatus. Thus, the centrifuge apparatus can centrifuge the contents of multi-welled containers with an acceleration of at least 2000 g (or at least 3000 g, 4000 g, 5000 g, etc.). In comparison to current centrifuge designs, this design generally prevents tilting of the apparatus that commonly gives rise to gyroscopic forces that impart additional load on the spindle bearings, which wastes motor power and limits the g-forces obtainable. This design also minimizes displacement of the shield during rotor rotation. The centrifuge apparatus can thus use motor power more effectively, have low displacement during vibration, have lower vibration emissions to the foundation of the apparatus, and have a general increased capacity to accommodate imbalanced rotor loading, among other advantages.

BRIEF DESCRIPTION OF THE DRAWINGS

These and other features, aspects, and advantages of the present invention will become better understood with regard to the following description, and accompanying drawings, where.

The skilled artisan will understand that the drawings are for illustration purposes only. The drawings are not intended to limit the scope of the present teachings in any way.

DETAILED DESCRIPTION OF THE INVENTION

Centrifuge Apparatus

Figure 1:
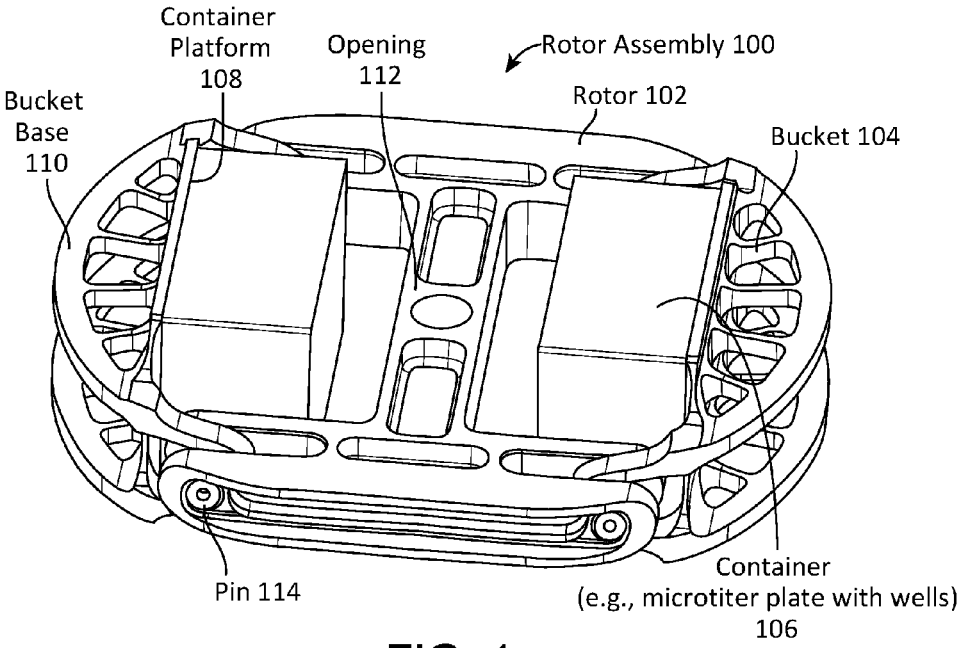
FIG. 1 depicts an isometric view of a rotor assembly, including a rotor and buckets holding containers for centrifugation, according to an embodiment of the invention. The rotor assembly is shown in the running position, with the buckets pivoted outward due to centrifugal force.

FIG. 1 depicts an isometric view of a rotor assembly 100 that is a component of a centrifuge apparatus, according to an embodiment of the invention. The rotor assembly 100 includes a rotor 102 and buckets 104 holding a payload, such as containers 106 for centrifugation. The payload can include any type of container or structure for holding materials, (e.g., samples), such as a vial, tube, bottle, flask, beaker, microplate or other multi-welled plate, a "dummy" plate, an empty plate, a placeholder device/container, a weight or other balancing mechanism, a holder/container with at least two wells for holding materials, among other examples. In some embodiments, the rotor 102 is solid and does not include buckets 104. The rotor assembly 100 is shown in the running position, with the buckets 104 pivoted outward due to centrifugal force. The rotor assembly 100 shown in FIG. 1 has two buckets 104 moveably attached to a rotor 102. However, other designs can include more or fewer buckets 104. Each bucket 104 has a payload/container platform 108 for holding the payload. As explained above, one example of a payload is a container 106 having a number of wells. The container platform 108 can have a variety of shapes and sizes to accommodate different types of payloads, such as containers. The buckets 104 are configured to swing the container 106 away from a rotational axis during rotation to centrifuge contents of the wells. The buckets 104 each include a bucket base 110 that is connected to and that is positioned beneath the container platform 108. Each bucket 104 is attached to the rotor 102 via a pin 114 on either side of the bucket 104. The pins 114 prove the hinge design that allows the buckets 104 to swing downward for loading and unloading of the containers 106 from the buckets 104 and to swing upward/outward during rotation of the rotor assembly 100 to centrifuge the contents of the wells of the containers 106. In the center of the rotor 102 is an opening 112 at which a spindle shaft is rigidly attached to the rotor 102 when the rotor assembly is inside the centrifuge. The spindle shaft (shown in later figures) thus can also be considered a part of the rotor assembly 100.

The containers 106 can take a variety of forms. In some embodiments, the containers 106 are microtiter plates or micro plates with multiple wells. The containers 106 can be 96-, 384- 1536-, 3456-, or 9600-well microtiter plates, or plates containing some other number of wells. The container 106 can also be another type of container, such as a PCR plate, a multi-well culture plates (e.g., cell culture plates), or any other type of container having more than one well. The container 106 can be a one-piece container or can include multiple pieces, such as separate tubes forming the wells. Where the rotor assembly 100 holds more than one container 106, the containers 106 can be the same or different containers. The containers 106 can also be of the same type, but have different numbers of locations for holding material (e.g., one 384-well microplate and one 1536-well microplate). The containers 106 can also contain different kinds of samples between the different containers or within a single container. While multi-welled containers are used as examples throughout much of this description, it is to be understood that the payload or container can include other structures or devices, as well, is not limited to any particular structure.

Various different forms of material can be contained within the container 106, such as a solid, a liquid, and a gel, among others. The material can also be various different material types, including genetic material, protein, various organisms (e.g., yeast, bacteria, etc.), reagents and solutions, beads, combinatorial libraries, gels, and so forth. Further, the sample contained in the container 106 can be sample for a variety of procedures, experiments, assays, etc., such as high throughput drug screening, compound management, toxicology, dissolution testing, immunoassays, clinical diagnostics, in vitro diagnostics, veterinary diagnostics, nucleic acid extraction, gel electrophoresis, genotyping, DNA extraction, PCR applications, genomics, proteomics, cellomics, cell biology, metabolomics, molecular biology, in vitro diagnostics, toxicology, microarray spotting, forensics, food analysis, colony picking, gel cutting, solubility assays, among a variety of others.

Figure 2:
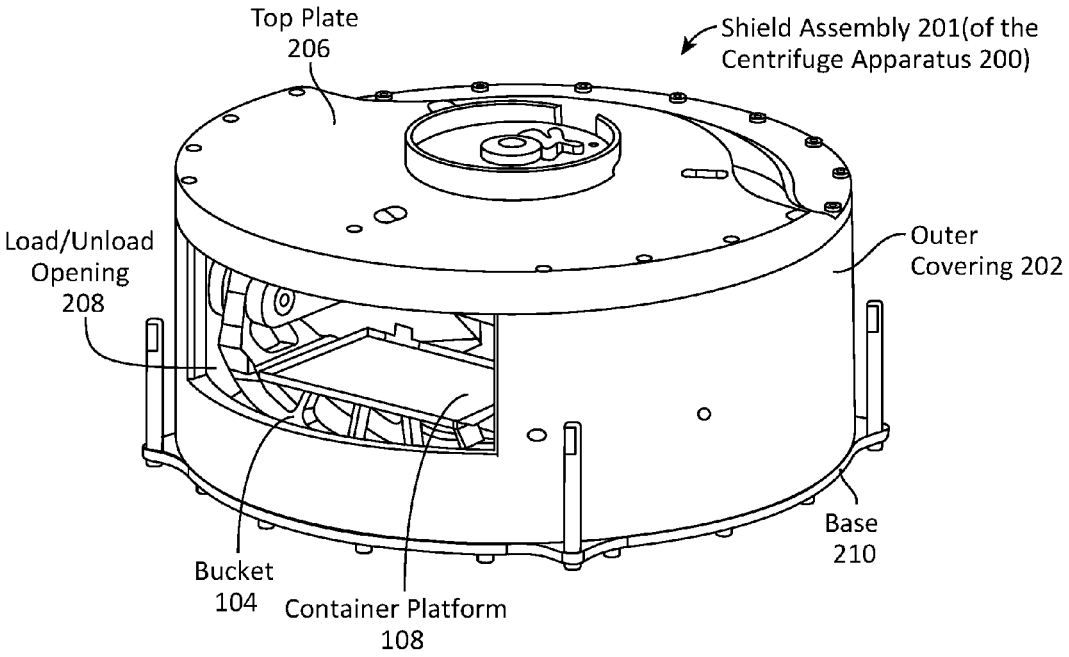
FIG. 2 depicts an isometric view of a shield assembly containing a rotor assembly, with the rotor assembly at rest in the load/unload position, according to an embodiment of the invention.

FIG. 2 depicts an isometric view of a shield assembly 201 of the centrifuge apparatus 200 (fixed structure of the apparatus 200 not illustrated in this Figure) containing a rotor assembly 100 (e.g., the rotor assembly 100 of FIG. 1), according to an embodiment of the invention. In FIG. 2, the rotor assembly 100 is at rest in the load/unload position. In this position, the buckets 104 of the rotor assembly 100 are positioned with the container platforms 108 generally parallel to the base 210 of the shield assembly 201 so that the containers 106 can be placed into or removed from the centrifuge apparatus 200 through the load/unload opening 208 in the shield assembly 201. The load/unload opening 208 can include a door that covers the opening 208 during operation of the centrifuge apparatus 200. The door can be opened for loading and unloading the containers 106. The shield assembly 201 has a top plate 206, a base 210, and an outer covering 202 that together sound the rotor assembly 100 contained inside the centrifuge apparatus 200. The centrifuge apparatus 200 can be shaped as shown in FIG. 2, including a generally-cylindrical outer covering 202 with a top plate 206 and base 210, though other shapes and structures are also possible (e.g., round, square, rectangular, etc.).

The centrifuge apparatus 200 is designed to have a small footprint and a small overall design to minimize the use of lab space and make it possible for the centrifuge to be incorporated into a variety of laboratory automation platforms. The apparatus 200 can be designed to have an approximate height of 30 centimeters, an approximate length of 40 centimeters, and an approximate width of 58 centimeters, though other sizes are also possible (e.g., any of the height, length, and width can be values that are less than 1000, 500, 200, 150, 100, 50, 40, 30, 20, 15 centimeters, etc., or any values or fractional values in between these numbers or any ranges including or between these numbers). The shield assembly can be designed to be approximately 35 centimeters in diameter and 22 centimeters in height, though other diameters (e.g., less than 1000, 500, 200, 150, 100, 50, 40, 30, 20 centimeters, etc., or any values or fractional values in between these numbers or any ranges including or between these numbers) and heights (less than 1000 500, 200, 150, 100, 50, 40, 30, 20 centimeters, etc., or any values or fractional values in between these numbers or any ranges including or between these numbers) are also possible. The apparatus 200 can further be designed with an approximate weight of 60 or 100 pounds, or with a weight of no more than 60 or 100 pounds. Similarly, the apparatus 200 can be designed to have a weight that is less than 30, 40, 50, 70, 80, 90, 110, 120, 130, 140, 150 pounds, etc., or any values or fractional values in between these numbers or any ranges including or between these numbers.

Figure 3:
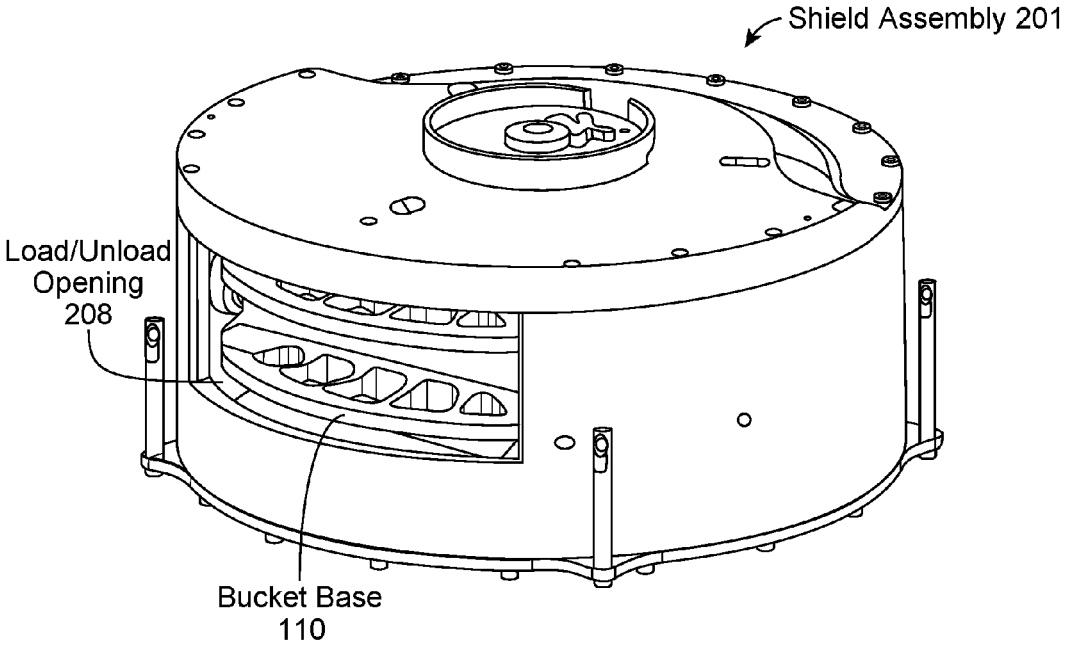
FIG. 3 depicts an isometric view of a shield assembly containing a rotor assembly, with the loading/unloading opening visible, according to an embodiment of the invention. The rotor assembly is shown in the running position, with the buckets pivoted outward due to centrifugal force

FIG. 3 depicts an isometric view of a shield assembly 201 containing a rotor assembly 100, according to an embodiment of the invention. The rotor assembly 100 is shown in the running position, with the buckets 104 pivoted outward due to centrifugal force. The bucket base 110 is visible through the load/unload opening 208.

Figure 4:
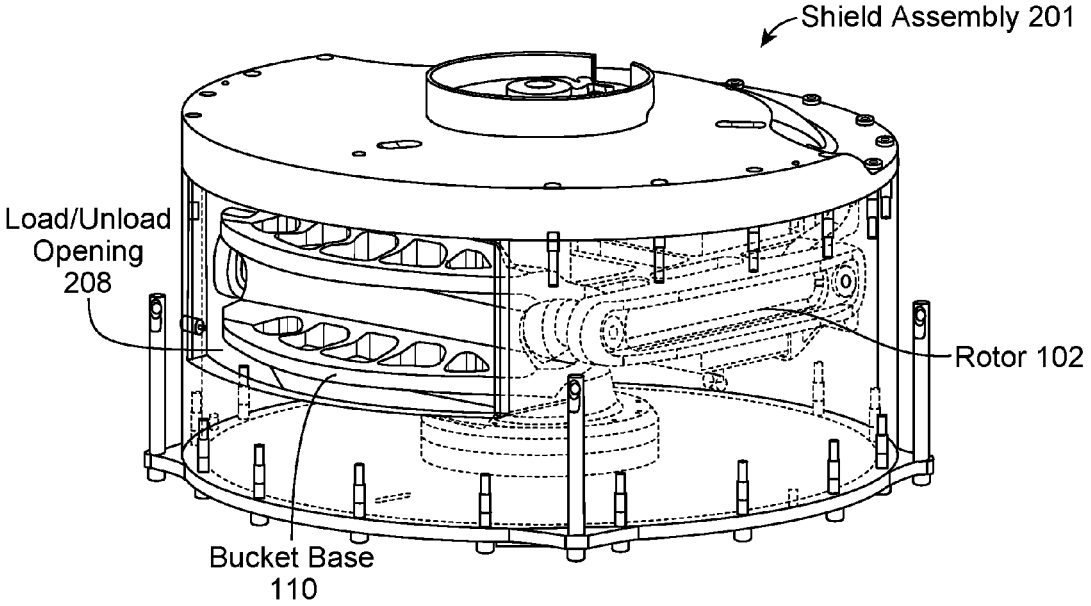
FIG. 4 depicts an isometric view of a shield assembly containing a rotor assembly, with the cylindrical shield transparent, according to an embodiment of the invention. The rotor assembly is shown in the running position, with the buckets pivoted outward due to centrifugal force

FIG. 4 depicts an isometric view of a shield assembly 201 containing a rotor assembly 100, according to an embodiment of the invention. The cylindrical shield or outer covering 202 is transparent in this figure, so the internal components are visible. The rotor assembly 100 is shown in the running position, with the buckets 104 pivoted outward due to centrifugal force.

Figure 5:
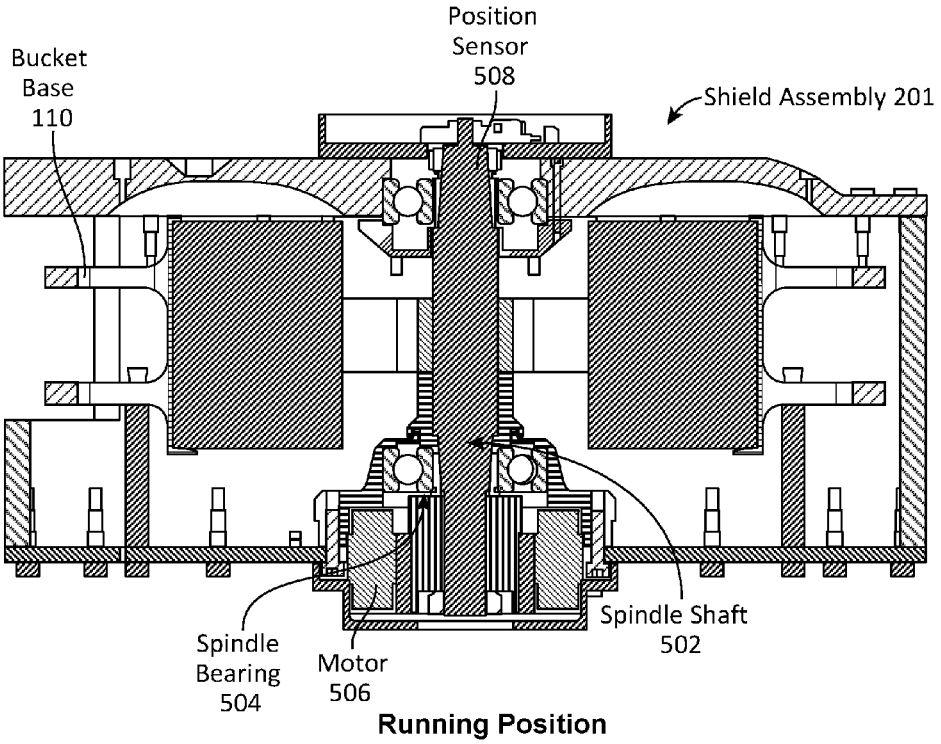
FIG. 5 depicts a cross-sectional, side view of a shield assembly containing a rotor assembly in the running position, according to an embodiment of the invention.

FIG. 5 depicts a cross-sectional, side view of a shield assembly 201 containing a rotor assembly 100 in the running position, according to an embodiment of the invention. The shield assembly 201 includes a motor 506 and a spindle shaft 502 attached within the shield assembly 201. The rotor assembly 100 is positioned within the shield assembly 201 and is operably connected to the motor 506 via the spindle shaft 502 that is rotated by the motor 506 and that rotates the rotor assembly 100 about the axis of rotation for the rotor assembly 100. Spindle bearings 504 associated with the spindle shaft 502 are also illustrated in FIG. 5, along with a position sensor 508 associated with the shield assembly 201 and rotor assembly 100 for detecting the position of the shield assembly 201 and/or rotor assembly 100 in the apparatus 200.

The suspendable mass (the shield assembly 201 and rotor assembly 100) is aligned such that the center of gravity of the suspendable mass is aligned with the axis of rotation of the rotor assembly 100 and is aligned with a plane containing the rotational imbalance force vector for the suspendable mass. In some embodiments, these alignments are exact alignments. In other embodiments, the alignment is performed such that the points/planes are aligned at least immediately adjacent to each other. For example, they can be less than 1 millimeter in any direction away from each other (e.g., 0.9, 0.8, 0.7, 0.6, 0.5, 0.4, 0.3, 0.2, 0.1, 0.05, 0.025, 0.01, 0.001, 0.0001 millimeters, etc., or any value or fractional value in between these numbers or any range including or between these numbers). In further embodiments, the points/planes are lined up within a tolerance of +/−0.1 millimeters. This alignment of the suspendable mass allows rotation of the container 106 with an acceleration of at least 2000 g. In some embodiments, the alignment of the suspendable mass allows rotation of at least 3000 g, 4000 g, 5000 g, 6000 g, 7000 g, 8000 g, 9000 g, 10,000 g, 20,000 g, 50,000 g, 100,000 g, etc., or any value or fractional value in between these numbers or any ranges including or between these numbers. In some embodiments, the centrifuge apparatus 200 has at least a 50 gram imbalance tolerance. In other embodiments, the apparatus 200 has at least a 100 gram imbalance tolerance. In still further embodiments, the apparatus 200 has an imbalance tolerance of 30, 40, 60, 70, 80, 90, 150, 200, 300 grams, etc., or any value or fractional value in between these numbers or any ranges including or between these numbers.

In designing the centrifuge apparatus 200, the alignment of the center of rotation with the center of gravity or of the center of mass with the axis of rotation and plane containing the rotational imbalance force vector can be performed in a number of manners. For example, software can be used to line up the points on a 3-dimensional image of the centrifuge apparatus 200. The software can be used to adjust the positioning in the X, Y, and/or Z directions of one or more of the points being lined up. The geometry of the shield assembly can be adjusted to align the overall center of gravity of the suspended portion with the axis of rotation and with the imbalance vector plane. The alignment of the apparatus 200 can be adjusted by modifying one or more components of the apparatus 200. If the center of gravity is positioned higher than needed, the thickness of various components in the apparatus 200 can be adjusted to lower the center of gravity. For example, material can be removed from the top plate 206 to move the center of gravity of the shield assembly 201 downward and center it with the center of rotation. Similarly, material can be removed from various other components in the suspendable mass or from multiple components to balance the device in the X, Y, and Z directions. The apparatus 200 can be balanced and configured to generally avoid wave movement, and instead have only or primarily side-to-side movement.

Alignment of the center of rotation with the center of gravity of the suspendable mass and/or the alignment of the center of mass with the axis of rotation and plane containing the rotational imbalance force vector minimizes or eliminates/prevents tilting or rotation of the shield assembly 201, which would otherwise waste motor power. This alignment can also ensure that forces due to imbalance do not impart torque (or impart minimal torque) on the shield assembly 201. The alignment and configuration of the apparatus 200 can further minimize tilting of the shield assembly 201 and rotor assembly 100 to avoid gyroscopic forces that impart additional load on the spindle bearings 504, which would otherwise waste motor power and limit the g-forces obtainable. The configuration of the apparatus 200 can also minimize displacement of the shield assembly 201 during rotation of the rotor assembly. In some embodiments, the center of mass of the suspendable mass is aligned with the axis of rotation and aligned with the plane containing the rotational imbalance force vector in an X, Y, and Z direction.

The apparatus 200 is also integratable into a laboratory automation system. For example, the apparatus can be integrated into a laboratory automation system that includes at least one robotic arm that loads and unloads containers from the apparatus 200. In other embodiments, the containers are loaded/unloaded from the apparatus 200 manually.

In some embodiments, the centrifuge apparatus 200 also has stabilization mechanism for the suspendable mass, according to an embodiment of the invention. The apparatus 200 can include tooling balls or spheres in the fixed structure of the apparatus 200. The spheres are engageable with V-grooves in the top plate 206 of the shield assembly 201. Since the shield assembly is suspended via compliant elements in the centrifuge apparatus 200 and floats generally freely within the apparatus 200, it is difficult for laboratory automation equipment to load and unload containers 106 from the centrifuge apparatus 200. For example, a lab automation platform or liquid handling system may include a robotic arm that moves micro plates around this automation equipment, including moving plates into and out of a centrifuge, making the centrifuge loading/unloading an automated, rather than manual, process. However, robotic arms commonly require precise positioning of the platforms onto which plates are loaded and unloaded, so may have difficulty loading and unloading plates from a suspendable mass (a rotor assembly 100 within a shield assembly) that floats freely within the fixed structure of the centrifuge apparatus 200. The movement of the suspendable mass can make it difficult for the robotic arm to properly place the containers 106. To manage this issue, the shield assembly is lifted into a load/unload position in which the spheres in the ceiling of the centrifuge apparatus 200 engage the V-grooves in the shield assembly 201 to stabilize the shield assembly within the centrifuge. Thus, the suspended shield assembly 201 is temporarily stabilized so a robot can load and unload containers 106 from the apparatus 200. Once loaded, the shield assembly 201 is dropped or moved downward so that the spheres disengage from the V-grooves, and the shield assembly 201 is again suspended within the centrifuge apparatus 200 and prepared for rotation of the rotor assembly 100. The shield assembly 201 is raised and lowered in this manner using a belt and pins to move the shield assembly up and down.

In some embodiments, the fixed structure of the centrifuge apparatus 200 includes a sensor (e.g., variable proximity sensor, switch, etc.) that detects imbalance in the apparatus. The sensor is located outside the shield assembly 201 and can be affixed to the fixed structure of the centrifuge apparatus 200, which enables a good signal-to-noise ratio. A variety of different sensor types can be used. If an analog sensor is used (which provides a variable measurement of shield assembly motion), then a "live" measurement of payload imbalance can be made, which can be used to predict bearing wear, etc. for the centrifuge apparatus 200.

In another embodiment, the shield assembly 201 and the rotor assembly 100 together comprise a rigid body to which a force is applied. The rotor assembly 100 is positioned within the stationary shield assembly 201, which can be suspended in the centrifuge apparatus 200 by compliant elements (e.g., springs to support the weight of the rigid body). The rigid body has its center of mass aligned with the axis of rotation and aligned with the horizontal plane bisecting the rigid body. A force is applied to the rigid body for rotating the rotor assembly 100 within the shield assembly 201. The line of action of the force contains the center of mass of the rigid body and the rigid body is positioned to accelerate in a generally or primarily translational manner, but not in (e.g., not in or not substantially in) a rotational manner responsive to the force applied. If an unsupported rigid body is acted upon by an external force, and that force line of action contains the center of mass of that rigid body, then the rigid body will tend to (in response to the applied force) accelerate translationally, rather than rotationally. Thus, this design allows the centrifuge apparatus 200 to avoid undesired rotation. This design generally does not interfere with or complicate normally accepted vibration isolation designs (the use of soft springs to support the static weight of the shield assembly 201 while permitting small vibrational motions, such that force transmitted to the foundation of the apparatus 200 is minimized).

Figure 6:
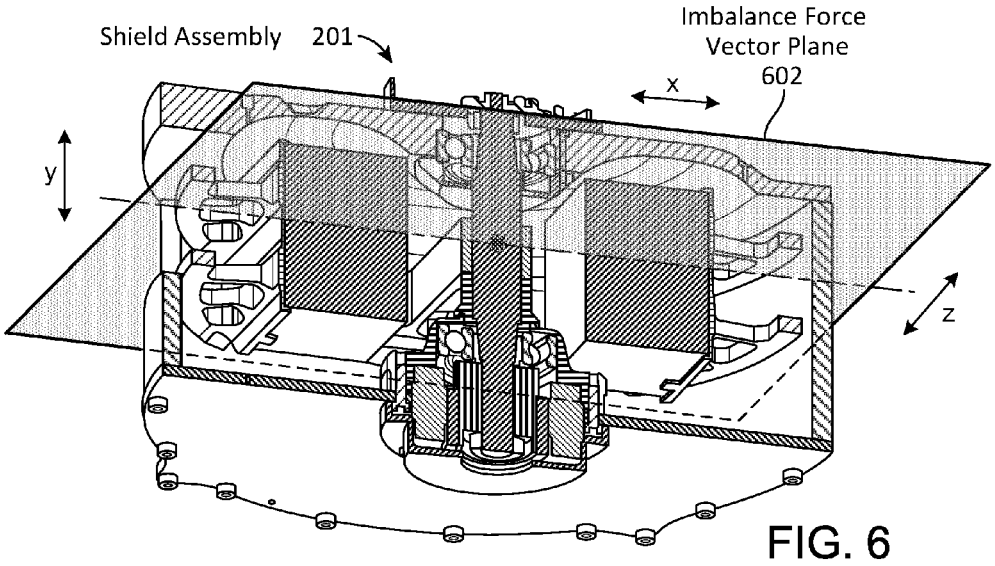
FIG. 6 depicts a cross-sectional, isometric view of a shield assembly, including showing an imbalance force vector plane, according to an embodiment of the invention.

FIG. 6 depicts a cross-sectional, isometric view of a shield assembly 201 containing a rotor assembly 100 in the running position, according to an embodiment of the invention. FIG. 6 further shows the imbalance force vector plane 602 that is a horizontal plane bisecting the shield assembly 201 and rotor assembly 100. The imbalance force vector is anchored at the axis of rotation of the rotor assembly 100.

Figure 7:
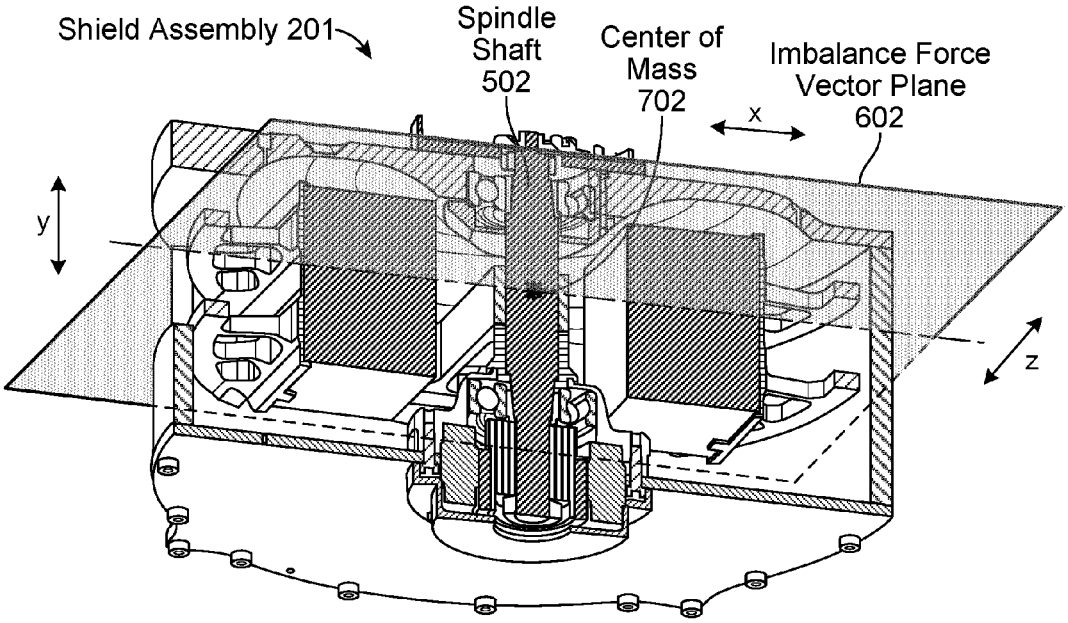
FIG. 7 depicts a cross-sectional, isometric view of a shield assembly, including showing an imbalance force vector plane aligned with the center of mass for the shield assembly and rotor assembly, according to an embodiment of the invention.

FIG. 7 depicts a cross-sectional, isometric view of a shield assembly 201 containing a rotor assembly 101 in the running position, according to an embodiment of the invention. FIG. 7 further shows the imbalance force vector plane 602 which is illustrated as being aligned with the center of mass 702 for the suspendable mass (shield assembly 201 and rotor assembly 100). The center of mass is illustrated as a small star shape in the center of the spindle shaft 502. The horizontal imbalance force vector plane 602 bisects the spindle shaft 502 through the center of mass 702. In some embodiments, the plane 602 bisects the center of mass 702 exactly. In other embodiments, the plane is at least immediately adjacent to the center of mass 702. For example, it can be less than 1 millimeter in any direction away from the center of mass 702 (e.g., 0.9, 0.8, 0.7, 0.6, 0.5, 0.4, 0.3, 0.2, 0.1 millimeters, etc., away from the center of mass, or any value or fractional value in between these numbers or any range including or between these numbers). In further embodiments, the plane is lined up with the center of mass within a tolerance of +/−0.1 millimeters, though the upper limit can be dependent on how much vibration can be tolerated by the user (e.g., is there nearby precision pipetting occurring or other procedures for which vibration is a problem). Preferably, the misalignment is designed to be zero. In some embodiments, the imbalance force vector acts on the center of the shield assembly 201 and minimizes or eliminates torque exerted by the imbalance force upon the shield assembly 201.

Figure 8:
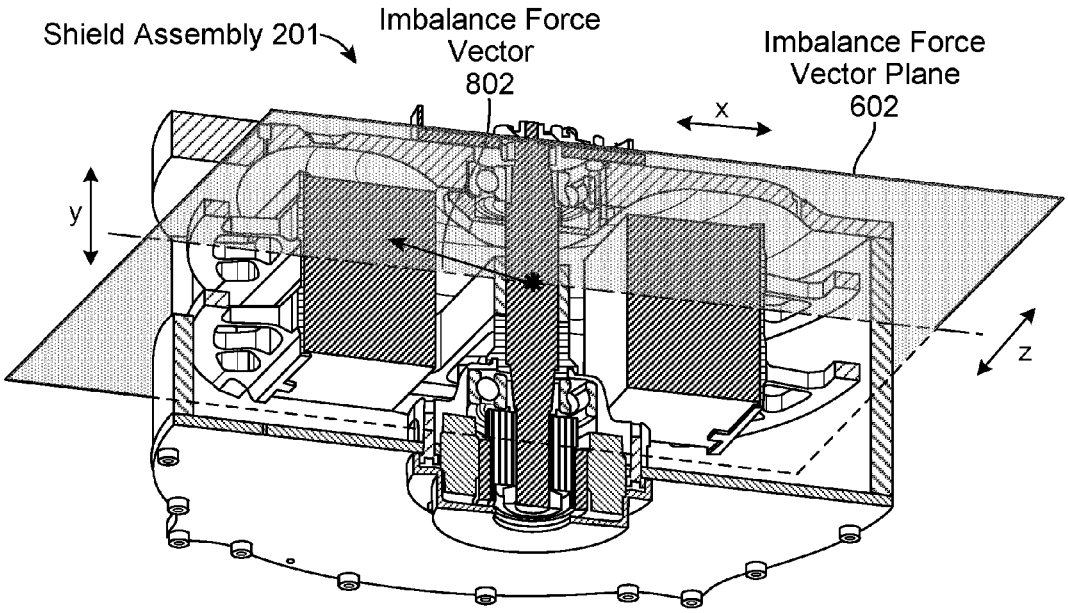
FIG. 8 depicts a cross-sectional, isometric view of a centrifuge apparatus, including showing an imbalance force vector aligned with the center of mass for the shield assembly and rotor assembly and in an imbalance force vector plane, according to an embodiment of the invention.

FIG. 8 depicts a cross-sectional, isometric view of a shield assembly 201 containing a rotor assembly 100 in the running position, according to an embodiment of the invention. FIG. 8 further shows the imbalance force vector 802 illustrated as an arrow pointing generally to the left. The imbalance force vector 802 is aligned with the center of mass for the suspendable mass. This vector 802 exists in the imbalance force vector plane 602 shown and rotates with the spindle shaft 502. The vector 802 increases in magnitude in proportion to the square of the rotor speed. Since the vector 802 is anchored to the same location as the center of gravity of the suspendable mass, tilting and torquing of the suspendable mass do not occur.

The configuration of the centrifuge apparatus 200 has a variety of advantages compared to other centrifuges. It is designed to permit high centripetal acceleration and imbalance tolerance. It has a more effective use of motor power, a lower displacement during vibration, lower vibration emissions to a foundation of the apparatus 200, and increased capacity to accommodate imbalanced loading of the rotor assembly. The device thus requires a lot less power and a smaller motor, so scalability is improved. Thus, the apparatus 200 has high centripetal acceleration and imbalance tolerance while maintaining a small footprint and being robot accessible or able to integrate with laboratory automation equipment. It can be used as a tabletop or benchtop apparatus, while still having the capability to centrifuge multi-welled containers 106.

FIGS. 1-8 illustrate a possible design for the apparatus. However, one of ordinary skill in the relevant art will recognize that a wide variety of other designs are also possible. Thus, FIGS. 1-8 are provided as illustrations of possible embodiments of the claimed invention.

Centrifuging Methods

Figure 9:
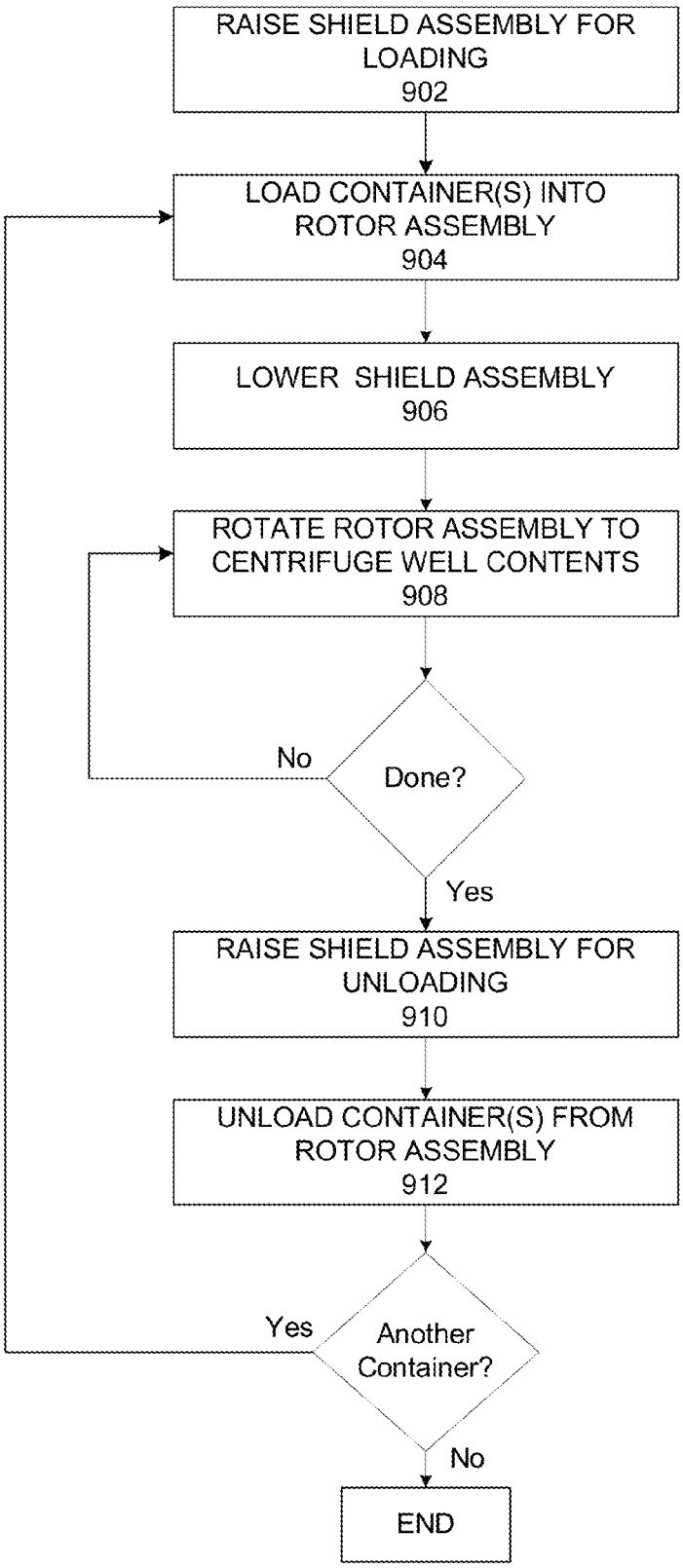
FIG. 9 is a flow diagram providing a method for centrifuging contents of wells of a container, according to an embodiment of the invention.

FIG. 9 is a flow diagram providing a method for centrifuging contents of wells of a container, according to an embodiment of the invention. It should be understood that these steps are illustrative only. Different embodiments of the invention may perform the illustrated steps in different orders, omit certain steps, and/or perform additional steps not shown in FIG. 9. The method can start and end at various points in the process, and typically is a continuous process with multiple steps occurring simultaneously, so FIG. 9 provides only an example of one ordering of method steps. In addition, the methods can be performed using centrifuge apparatus 200 (or one or more of its components) or another apparatus capable of performing the steps provided below.

In the method of centrifuging contents of wells of a container, a centrifuge apparatus is used and containers (e.g., multi-welled containers) are loaded into and unloaded from the shield assembly of the centrifuge. The centrifuge operation can be a tabletop or benchtop design that is integratable with other laboratory automation, so has a small enough footprint to be easily used within various labs. In some embodiments, the centrifuge apparatus has a size of less than 40 cm×58 cm×30 cm (length×width×height). In some embodiments, for the loading of the centrifuge, the method comprises raising 902 a shield assembly suspended within the centrifuge apparatus to prepare for loading. This raising 902 can be performed to engage V-grooves in the shield assembly with solid spheres (e.g., tooling balls) placed on the inside upper surface or ceiling of the centrifuge apparatus. This can stabilize the shield assembly for loading and unloading the container by, for example, a robot or a robotic arm of a laboratory automation platform. The method further comprises loading 904 one or more containers into the rotor assembly. In some embodiments, the method then comprises lowering 906 the shield assembly to prepare for rotation. This lowering 906 can disengage the spheres on the centrifuge apparatus from the V-grooves to suspend the shield assembly in the centrifuge apparatus. The shield assembly is now in the running position and ready for centrifugation.

With the shield assembly suspended in the centrifuge apparatus, the centrifuging process can now begin. The method thus further comprises rotating 908 the rotor assembly within the shield assembly around a rotational axis with a centripetal acceleration of at least 2000 g (or at least 3000 g, 4000 g, 5000 g, etc.) to centrifuge the samples or separate one or more components of samples in the wells. In some embodiments, the center of rotation of the rotor assembly is aligned with the center of gravity of the centrifuge apparatus. In some embodiments, the center of mass of the centrifuge apparatus is aligned with the axis of rotation and is aligned with a plane containing a rotational imbalance force vector. The alignment of the centrifuge apparatus permits the rotor assembly to rotate with the centripetal acceleration of at least 2000 g (or at least 3000 g, 4000 g, 5000 g, etc.).

Once the centrifuging is complete, the container can be removed from the centrifuge. For removal of the container, the method can include again raising 910 the shield assembly suspended within the centrifuge apparatus to prepare for unloading. In some embodiments, this raising 910 engages the V-grooves in the shield assembly with the spheres on the centrifuge apparatus. This stabilizes the rotor assembly for unloading of the container. The method then comprises unloading 910 one or more containers from the centrifuge apparatus. Where additional centrifuging procedures are to be performed, another container can be loaded 904 into the centrifuge apparatus and be centrifuged in the same manner.

While the present teachings are described in conjunction with various embodiments, it is not intended that the present teachings be limited to such embodiments. On the contrary, the present teachings encompass various alternatives, modifications, and equivalents, as will be appreciated by those of skill in the art. Most of the words used in this specification have the meaning that would be attributed to those words by one skilled in the art. Words specifically defined in the specification have the meaning provided in the context of the present teachings as a whole, and as are typically understood by those skilled in the art. In the event that a conflict arises between an art-understood definition of a word or phrase and a definition of the word or phrase as specifically taught in this specification, the specification shall control. It must be noted that, as used in the specification and the appended claims, the singular forms "a," "an," and "the" include plural referents unless the context clearly dictates otherwise.

What is claimed is:

1. A centrifuge apparatus comprising a suspendable mass capable of being suspended within the centrifuge apparatus, the suspendable mass comprising:

a shield assembly that is less than 50 centimeters in diameter and 40 centimeters in height;

a motor attached to the shield assembly; and a rotor assembly positioned within the shield assembly, the rotor assembly comprising:

a rotor, a spindle shaft attached to the rotor and operably connected to the motor for rotating the rotor about an axis, and at least two buckets moveably attached to the rotor, each bucket having a container platform for holding a container having a plurality of wells, the buckets configured to swing the container away from the spindle shaft during rotation to centrifuge contents of the wells, wherein a center of mass of the suspendable mass is aligned with a point formed by an intersection of an axis of rotation of the rotor assembly and a plane containing a vector representing a rotational imbalance force expected to act on the suspendable mass during operation of the apparatus, the alignment of the suspendable mass allowing rotation of the container with an acceleration of at least 2000 g.

2. The apparatus of claim 1, wherein each bucket contains a container having a plurality of wells.

3. The apparatus of claim 1, wherein the centrifuge apparatus is capable of rotation of the container with an acceleration of at least 5000 g.

4. The apparatus of claim 1, further comprising a plurality of spindle bearings associated with the spindle shaft of the rotor assembly.

5. The apparatus of claim 1, further comprising a position sensor associated with the shield assembly and rotor assembly for detecting the position of the rotor assembly within the shield assembly.

6. The apparatus of claim 1, wherein the shield assembly is less than 35 centimeters in diameter and 22 centimeters in height.

7. The apparatus of claim 1, wherein the apparatus has at least a 50 gram imbalance tolerance.

8. The apparatus of claim 1, wherein the apparatus weighs no more than 100 pounds.

9. The apparatus of claim 1, wherein the center of mass of the suspendable mass is aligned with a point formed by an intersection in an X, Y, and Z direction.

10. The apparatus of claim 1, wherein the container comprises a 96-well microtiter plate.

11. The apparatus of claim 1, wherein the container comprises a 384-well or a 1536-well microtiter plate.

12. The apparatus of claim 1, wherein the apparatus is a tabletop or benchtop apparatus.

13. The apparatus of claim 1, wherein the apparatus is integratable into a laboratory automation system having at least one robotic arm that loads and unloads containers from the apparatus.

14. The apparatus of claim 1, further comprising a fixed structure surrounding the suspendable mass and mountable to a foundation separate from the centrifuge apparatus.

15. A centrifuge apparatus comprising a suspendable mass that is suspendable within the centrifuge apparatus, the suspendable mass comprising:

a shield assembly, the shield assembly is less than 50 centimeters in diameter and 40 centimeters in height;

a rotor positioned within the shield assembly for rotation around an axis of rotation, wherein a center of mass of the suspendable mass is aligned with a point formed by an intersection of the axis of rotation of the rotor and a plane containing a vector representing a rotational imbalance force for the suspendable mass;

a plurality of buckets moveably attached to the rotor for holding a container having a plurality of wells; and a motor operably connected to the rotor within the shield assembly for rotating the rotor around the axis of rotation with an acceleration of at least 2000 g to centrifuge contents of the wells.

16. The apparatus of claim 15, wherein the alignment of the rotor allows rotation of the container with an acceleration of at least 5000 g.

17. The apparatus of claim 15, wherein the apparatus weighs no more than 60 pounds.

18. The apparatus of claim 15, wherein the apparatus has at least a 100 gram imbalance tolerance.

19. The apparatus of claim 15, wherein the container comprises a 384-well microtiter plate.

20. The apparatus of claim 15, wherein the container comprises a 3456- or 9600-well microtiter plate.

21. The apparatus of claim 15, wherein the apparatus is a benchtop apparatus that is integratable into a laboratory automation system having at least one robotic arm that loads and unloads containers from the apparatus.

22. The apparatus of claim 15, wherein the imbalance force vector acts on the center of mass of the shield assembly and resides in a horizontal plane bisecting the height of the rotor.

23. A centrifuge apparatus comprising:

a rigid body comprising a stationary shield and a rotor assembly that are suspended within the centrifuge apparatus, the rotor assembly capable of rotation around an axis of rotation within the stationary shield, the rigid body having a center of mass aligned with the axis of rotation and aligned with a horizontal plane bisecting the height of the rotor assembly, the rotor assembly is less than 50 centimeters in diameter and 40 centimeters in height, such that when force is applied to the rigid body due to imbalance of weight on the rotor assembly during use, a line of action of the force contains the center of mass of the rigid body to avoid tilting or rotation of the shield assembly, and such that the rigid body accelerates in a translational manner, but not in a rotational manner, responsive to the force applied.

24. The apparatus of claim 1, wherein the center of gravity of the shield assembly is configured via a process in which material is removed to decrease a thickness of a wall of the shield assembly or material is added to increase the thickness of the wall of the shield assembly to achieve alignment of the apparatus.

25. A method of centrifuging contents of wells of a container with the centrifuge apparatus of claim 1, the method comprising:

loading the container into the rotor assembly within the centrifuge apparatus, the container having multiple wells containing samples;

rotating the rotor assembly within the centrifuge apparatus around the axis of rotation of the rotor assembly with a centripetal acceleration of at least 2000 g to centrifuge samples in the wells, the center of mass of the suspendable mass aligned with the point formed by the intersection of the axis of rotation of the rotor assembly and the plane containing the vector representing the rotational imbalance force expected to act on the suspendable mass; and unloading the container from the centrifuge apparatus, the one or more components of the samples having been centrifuged by the rotation of the rotor assembly.

26. The method of claim 25, wherein the container is loaded into the rotor assembly and unloaded from the rotor assembly by a robotic arm of a laboratory automation system with which the centrifuge apparatus is integrated.

27. The method of claim 25, wherein rotating comprises rotating with a centripetal acceleration of at least 5000 g.

* * * * *